US009359772B2

(12) United States Patent
Prica et al.

(10) Patent No.: US 9,359,772 B2
(45) Date of Patent: Jun. 7, 2016

(54) WALL PANEL ASSEMBLY

(71) Applicant: PG Building Envelope Inc., Waterloo (CA)

(72) Inventors: Drazen Prica, West Montrose (CA); Ognjen Prica, Burlington (CA)

(73) Assignee: PG Building Envelope Inc., Waterloo (CA)

( * ) Notice: Subject to any disclaimer, the term of this patent is extended or adjusted under 35 U.S.C. 154(b) by 0 days.

(21) Appl. No.: 14/689,193

(22) Filed: Apr. 17, 2015

(65) Prior Publication Data

US 2015/0308123 A1 Oct. 29, 2015

Related U.S. Application Data

(60) Provisional application No. 61/983,056, filed on Apr. 23, 2014.

(51) Int. Cl.
*E04F 13/08* (2006.01)

(52) U.S. Cl.
CPC ..... *E04F 13/083* (2013.01); *E04F 13/0801* (2013.01); *E04F 13/0889* (2013.01)

(58) Field of Classification Search
CPC . E04F 13/0801; E04F 13/0803; E04F 13/081; E04F 13/0821; E04F 13/0823; E04F 13/0825; E04F 13/0828; E04F 13/0812; E04F 13/0816; E04F 13/083; E04F 13/0889
See application file for complete search history.

(56) References Cited

U.S. PATENT DOCUMENTS

| | | | |
|---|---|---|---|
| 1,876,624 | A | 9/1932 | Daughaday |
| 2,753,624 | A | 7/1956 | Taylor |
| 3,443,350 | A | 5/1969 | Birum, Jr. |
| 3,566,561 | A | 3/1971 | Tozer |
| 4,015,390 | A | 4/1977 | Howorth |
| D250,847 | S | 1/1979 | Lemieux |
| RE30,432 | E | 11/1980 | Stoakes |
| 4,370,841 | A | 2/1983 | Hayashi |
| 4,418,506 | A | 12/1983 | Weber et al. |
| 4,570,390 | A | 2/1986 | Wendt |
| 4,757,657 | A | 7/1988 | Mitchell et al. |
| 4,798,035 | A | 1/1989 | Mitchell et al. |
| 4,850,167 | A | 7/1989 | Beard et al. |
| 4,984,400 | A | 1/1991 | Bockmiller |
| 4,996,809 | A | 3/1991 | Beard |

(Continued)

FOREIGN PATENT DOCUMENTS

| | | | |
|---|---|---|---|
| CA | 2157481 | C | 7/1995 |
| CA | 2533381 | A1 | 7/2006 |

(Continued)

*Primary Examiner* — Elizabeth A Quast
(74) *Attorney, Agent, or Firm* — Steven W. Smith

(57) ABSTRACT

A wall panel assembly includes a panel having a main wall portion and sidewall portions extending away from the main wall portion, a plurality of frame members each having opposing end portions and a first channel extending between the opposing end portions, and a plurality of corner members. Each corner member has a pair of conjoined frame member coupling portions each for coupling with a corresponding end portion of a corresponding one of the frame members for defining a support frame for supporting the panel. Each frame member coupling portion has a second channel extending therealong normal to each of the first channels. Fasteners extend through the sidewall portions of the panel into the first channels and second channels to couple the panel with the support frame.

20 Claims, 7 Drawing Sheets

(56) References Cited

U.S. PATENT DOCUMENTS

| | | | | |
|---|---|---|---|---|
| 5,014,477 | A | 5/1991 | MacDonald | |
| 5,065,557 | A | 11/1991 | Laplante et al. | |
| 5,070,667 | A | 12/1991 | Schulte | |
| 5,177,921 | A | 1/1993 | Dempster | |
| 5,263,292 | A | 11/1993 | Holland et al. | |
| 5,307,596 | A | 5/1994 | Bockmiller | |
| 5,307,600 | A | 5/1994 | Simon, Jr. et al. | |
| 5,371,981 | A | 12/1994 | Bockmiller | |
| 5,414,967 | A | 5/1995 | Cates et al. | |
| 5,611,184 | A | 3/1997 | Felix et al. | |
| 5,628,581 | A | 5/1997 | Hintz et al. | |
| D392,054 | S | 3/1998 | McGee et al. | |
| 5,893,245 | A * | 4/1999 | Sekiguchi | E04F 13/0816 403/295 |
| 6,016,632 | A | 1/2000 | McGee et al. | |
| 6,035,598 | A | 3/2000 | Sukolics et al. | |
| 6,138,419 | A | 10/2000 | Sekiguchi et al. | |
| 6,155,014 | A | 12/2000 | Wagner | |
| 6,209,275 | B1 | 4/2001 | Cates et al. | |
| 6,330,772 | B1 | 12/2001 | Mitchell et al. | |
| 6,484,465 | B2 | 11/2002 | Higgins | |
| 6,615,556 | B2 | 9/2003 | Cates et al. | |
| 6,634,149 | B2 | 10/2003 | Cates et al. | |
| 6,745,527 | B1 | 6/2004 | Sherman et al. | |
| 6,748,709 | B1 | 6/2004 | Sherman et al. | |
| 6,802,171 | B2 | 10/2004 | McKinnon | |
| 7,096,629 | B1 * | 8/2006 | Cox | E04F 13/0814 52/235 |
| 7,472,521 | B2 | 1/2009 | Bilge | |
| 7,562,504 | B2 | 7/2009 | Herbst et al. | |
| 7,621,084 | B2 | 11/2009 | Bilge | |
| 7,716,891 | B2 | 5/2010 | Radford | |
| 7,779,584 | B2 | 8/2010 | Arias | |
| 7,937,902 | B1 | 5/2011 | Smith et al. | |
| 8,011,146 | B2 * | 9/2011 | Krause | F41H 5/263 52/235 |
| 8,033,066 | B2 | 10/2011 | Griffiths | |
| 8,127,507 | B1 | 3/2012 | Bilge | |
| 8,166,716 | B2 | 5/2012 | Macdonald et al. | |
| 8,191,327 | B2 | 6/2012 | Griffiths et al. | |
| 8,225,572 | B2 | 7/2012 | Wallace | |
| 8,240,099 | B2 | 8/2012 | Hummel, III | |
| 8,316,599 | B2 | 11/2012 | Griffiths | |
| 8,511,023 | B1 | 8/2013 | Gulbrandsen et al. | |
| 8,555,577 | B2 | 10/2013 | Maday et al. | |
| 8,596,007 | B2 | 12/2013 | Hibbs | |
| 2002/0124514 | A1 | 9/2002 | Higgins | |
| 2006/0179744 | A1 | 8/2006 | Lynch et al. | |
| 2007/0022682 | A1 * | 2/2007 | Morgenegg | E04F 13/0889 52/235 |
| 2010/0037549 | A1 | 2/2010 | Lynch et al. | |
| 2010/0236186 | A1 | 9/2010 | Radford | |
| 2012/0096799 | A1 | 4/2012 | Wright | |

FOREIGN PATENT DOCUMENTS

| | | | |
|---|---|---|---|
| CA | 2756279 | A1 | 4/2012 |
| CA | 2775275 | C | 10/2013 |

* cited by examiner

WALL PANEL ASSEMBLY

FIELD OF THE INVENTION

The present invention relates to architectural wall panel assemblies. More particularly, the present invention relates to architectural wall panel assemblies that are used for covering the exterior walls of an existing architectural structure.

BACKGROUND

Architectural wall panel systems are used for covering the exterior of existing commercial, industrial and residential structures with panels which are resistant to damage from sun, dirt, moisture, fire, and many other environmental elements.

The main components for a wall panel system include a panel formed from an aluminum or composite material that is coupled to a supporting frame made up of extruded members. The frame is secured to the panel by fasteners such as pin-drive anchors, screws or nails that extend through both the panel and the extruded members. There are a number of problems with systems using this method of attachment.

Different environmental temperatures as well as the effects of moisture can cause uneven expansion and contraction in different areas of the panel, the extruded members or both. Uneven expansion and contraction can cause gaps to form between the panel and the extruded members or at the corners of the panel where the panel is bent or folded to form a side wall to connect with the supporting frame. This can not only cause structural damage to the wall panel system over time but also has a negative effect on the aesthetic of the wall panel system for the exterior of the building to which it is attached.

Some wall panel systems currently available on the market may use precise pre-drilling of holes in the extruded members and the panel prior to assembly of the wall panel system. A fastener is then passed through the hole in the panel and the extruded member to fasten the two components together. This method requires a precision drilling machine such as a CNC (Computer Numerical Control) operator, which adds to the expense and time required for manufacture. Moreover, the bend radius of the panel can vary which causes failure of the holes in the panel and the extruded member to line up properly at the assembly stage.

Holes in the extruded members and the panel can also be drilled at the assembly stage. Together with the panel, each extruded member must be secured first with clamps and holes are drilled by use of a hand drill. A fastener is then passed through both the panel and the extruded member to fasten the two components together. In such systems, the holes are often not consistent in size and may not be properly aligned. This can make it difficult or impossible to insert a fastener through both the panel and the extruded member. Moreover, this production method is labor intensive and slow. The possibility of damaging one or both of the panel and the extruded member is increased. Drilling at the assembly stage can cause particles, chips or filings of the panel and extrusion material to contaminate the assembly. These particles, chips and filings can scratch the panel and have a negative effect on the aesthetic for the exterior of the building to which the assembly is attached. Such damage may also void warranties existing on the product. Moreover, the particles, chips and filings can interfere with achieving a close fit between components in the assembly.

It is therefore desirable to have a wall panel system which is efficiently and economically assembled and which reduces the risk of damage to the panel or to the support frame during assembly. It is also desirable to have a wall panel system which is adaptable to changing environmental conditions over the life of the wall panel assembly.

BRIEF DESCRIPTION

A wall panel assembly includes a panel having a main wall portion and sidewall portions extending away from the main wall portion, a plurality of frame members each having opposing end portions and a first channel extending between the opposing end portions, and a plurality of corner members. Each corner member has a pair of conjoined frame member coupling portions each for coupling with a corresponding end portion of a corresponding one of the frame members for defining a support frame for supporting the panel. Each frame member coupling portion has a second channel extending therealong normal to the first channel of each frame member. A plurality of fasteners may be extended through the sidewall portions of the panel into the first channel of each frame member and into the second channel of each frame member coupling portion for coupling the panel with the support frame.

Each frame member end portion may include a pair of oppositely disposed corner member receiving slots and each frame member coupling portion of each corner member may be received by the pair of oppositely disposed corner member receiving slots of the corresponding end portion of the corresponding one of the frame members.

At least one of the plurality of frame members may include a wall coupling portion extending therefrom. At least one wall coupling member may include a support frame coupling portion coupled with the wall coupling portion of the at least one of the plurality of frame members for supporting the wall panel assembly relative to a structural wall.

The wall coupling portion of the at least one of the plurality of frame members may be a lip receiving slot and the support frame coupling portion may include a lip which may be received by the lip receiving slot when the wall coupling member is attached to the structural wall.

The wall coupling member may include a hook portion for extending toward the wall coupling portion of an adjacent wall panel assembly frame member when the wall coupling member is attached to the structural wall. The hook portion may couple the wall coupling member with the wall coupling portion of the adjacent wall panel assembly frame member. The hook portion may include a shank portion, a base portion and a point portion. The shank portion and the point portion may have a gap therebetween. The point portion may further include a first protuberance extending into the gap for engagement with a second protuberance extending toward the first protuberance from the wall coupling portion of the adjacent wall panel assembly frame member when the wall coupling portion of the adjacent wall panel assembly frame member is received within the gap.

The at least one wall coupling portion may include a first protuberance for snap fit engagement when the at least one wall coupling portion. The at least one wall coupling portion may be received within a gap of a hook portion of an adjacent wall panel assembly. The hook may have a shank portion, a base portion and a point portion. The shank portion and the point portion may define the gap therebetween and the point portion may further include a second protuberance extending into the gap for engagement with the first protuberance.

The present wall panel assembly does not require drilling of holes in the support frame. Accordingly, it is not necessary to have precise alignment between two holes in the panel and the frame members. Rather, the fastener can pass through the wall panel side walls at any location that corresponds to the first channel extending along the frame members and the second channels extending along the corner members. This reduces the time and complexity of manufacture and reduces the risk of damaging the wall panel system during assembly and potentially voiding warranties existing on the manufacturing materials. This assembly also reduces the need for precise drilling and alignment of holes in the panel side wall and the support frame.

BRIEF DESCRIPTION OF THE DRAWINGS

For a better understanding of the nature and objects of the present invention reference may be had by way of example to the accompanying diagrammatic drawings in which.

DETAILED DESCRIPTION

Figure 1:
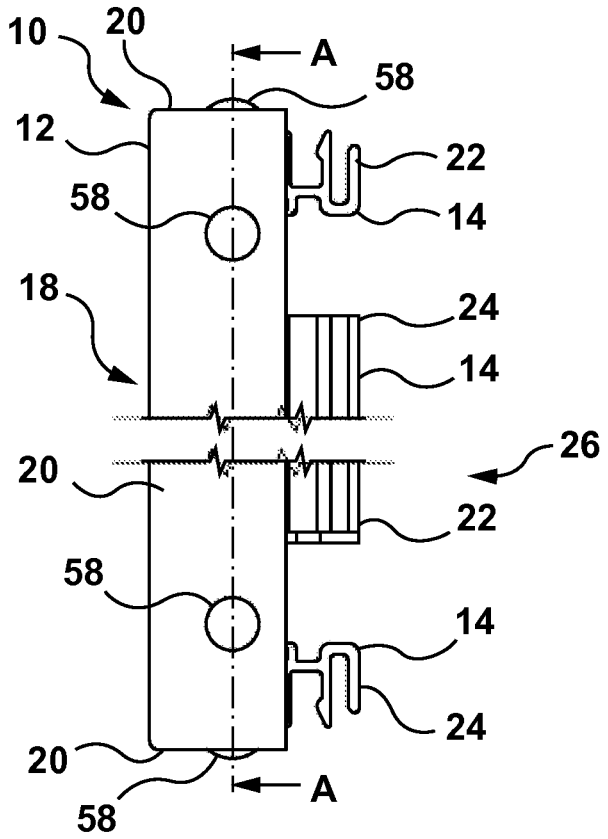
FIG. 1 is a side view of the wall panel assembly.
Figure 2:
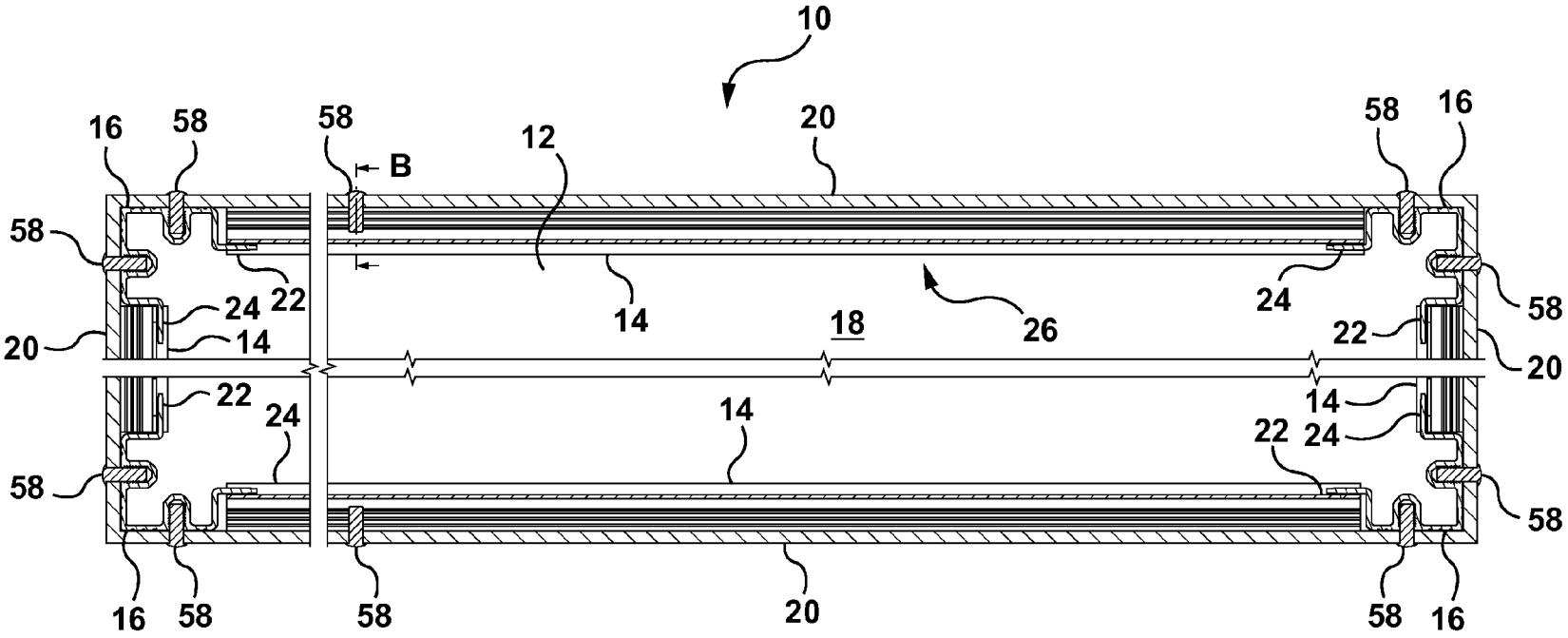
FIG. 2 is a cross section view of the wall panel assembly taken along line A-A of FIG. 1.

The wall panel assembly 10 is shown in FIGS. 1 and 2. The wall panel assembly 10 includes at least one wall panel 12, a plurality of frame members 14 and a plurality of corner members 16 which are hidden from view in FIG. 1. Each wall panel 12 has a main wall portion 18 and side walls 20 which are preferably perpendicularly disposed relative to the main wall portion 18 and extend away from the main wall portion 18. The end portions 22, 24 of the frame members 14 are coupled with the corner members 16 to provide a support frame 26. The side walls 20 of the wall panel 12 are coupled with the frame members 14 and the corner members 16 to couple the wall panel 12 with the support frame 26.

The wall panel 12 may be formed from any suitable material such as aluminum, plastic or may be formed from a composite material. The wall panel 12 may also be formed from sheets of an aluminum or plastic material in combination with sheets of a composite material. For example, the wall panel 12 may be formed from two aluminum sheets sandwiching a sheet of composite material. Each frame member 14 includes oppositely disposed end portions 22, 24.

The embodiment of FIG. 2 shows four frame members 14 and, correspondingly, four corner members 16. It should be understood that any number of frame members 14 and corner members three or greater may be used to assemble the support frame 26. Accordingly, the support frame 26 may be triangular, quadrilateral, pentagonal, etc. . . . The wall panel 12 corresponds in shape with the support frame 26.

Figure 3:
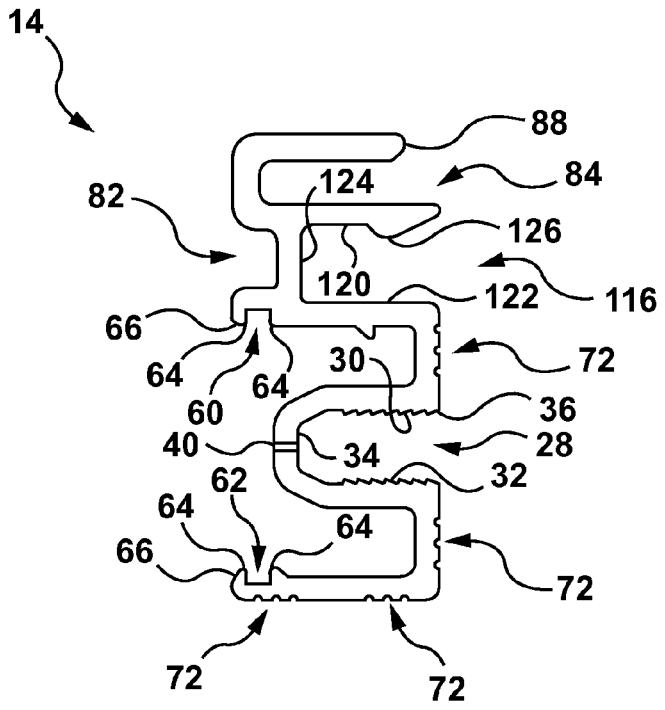
FIG. 3 is a side view of the frame member shown in FIG. 2.

FIG. 3 is a side view of a frame member 14. The frame member 14 is preferably formed by an extrusion process and may be made of any suitable material. Such suitable materials may include, for example, aluminum, steel or plastic. The frame member 14 has a first channel 28 defined by two oppositely disposed first channel side walls 30, 32, a first channel base wall 34 and a first channel mouth portion 36. One or both of the first channel side walls 30, 32 may be textured for engagement with an expanding portion of a rivet or pin-drive anchor (not shown in FIG. 2) or may be threaded for engagement with a screw or threaded bolt (not shown in FIG. 2). As shown in FIG. 3, the first channel 28 may taper near the first channel base wall 34. The first channel 28 extends longitudinally along frame member 14 between opposite end portions 22, 24. The first channel base wall 34 may include one or more first channel apertures or holes 40 for allowing moisture to exit the first channel 28 should any happen to accumulate therewithin. In an alternative embodiment, apertures 40 may pass through one or both of the first channel side walls 30, 32.

Figure 4:
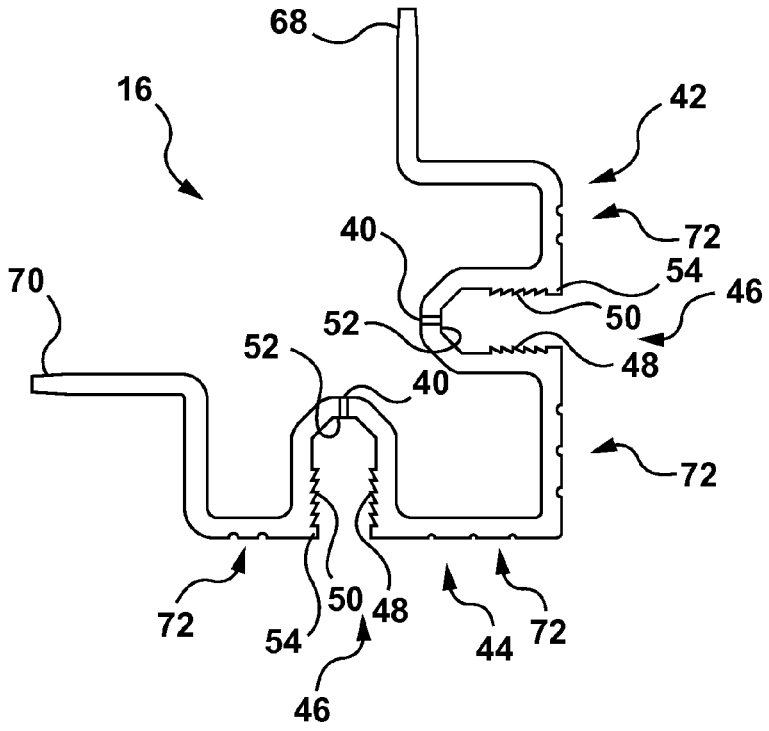
FIG. 4 is a top view of the corner member shown in FIG. 2.

FIG. 4 is a top view of a corner member 16. The corner member 16 is preferably formed by an extrusion process and may be made of any suitable material. Such suitable materials may include, for example, aluminum, steel or plastic. Corner member 16 includes a pair of conjoined frame member coupling portions 42, 44. Each one of the frame member coupling portions 42, 44 is for coupling with a corresponding one of the oppositely disposed end portions 22, 24 of a corresponding one of the frame members 14 (not shown in FIG. 4). The corner members 16 and frame members 14, once coupled with each other, form the support frame 26. In the embodiment shown in FIG. 2, the frame member coupling portions 42, 44 are perpendicularly disposed relative to one another in order to facilitate the assembly of the rectangular support frame 26 that is shown. The relative angle between the frame member coupling portions 42, 44 may be different for support frames that are not quadrilateral.

Each frame member coupling portion 42, 44 has a second channel 46. Each second channel 46 is defined by two oppositely disposed second channel side walls 48, 50, a second channel base wall 52 and a second channel mouth portion 54. One or both of the second channel side walls 48, 50 may be textured for engagement with a rivet (not shown in FIG. 4) or threaded for engagement with a screw or threaded bolt (not shown in FIG. 4). As shown in FIG. 4, the second channels 46 may taper near the second channel base wall 52. The second channels 46 extend longitudinally along the corner member 16. In the wall panel assembly 10, frame members 14 and corner members 16 are positioned normal or perpendicularly relative to one another. Accordingly, the first channels 28 are normal or perpendicular relative to the second channels 46 and vice versa.

With reference to FIGS. 1 to 4, the side walls 20 of the wall panel 12 are coupled with the frame members 14 and corner members 16 by passing a fastener 58 through the side walls 20 and into each of the first channels 28 and each of the second channels 46. The fastener 58 may pass through holes which have been drilled through the side wall 20. The fastener 58 engages the first channel side walls 30, 32 of the first channels 28 and the second channel side walls 48, 50 of each second channel 46 to secure the wall panel 12 with the support frame 26. Securing the side walls 20 with the corner members 16 in this manner provides a tight abutment between adjacent side walls 20 at the corners of the support frame 26. As with the first channels 28, the second channels 46 may also include apertures 40 for allowing moisture to exit the second channel, should any moisture accumulate therein.

Figure 5:
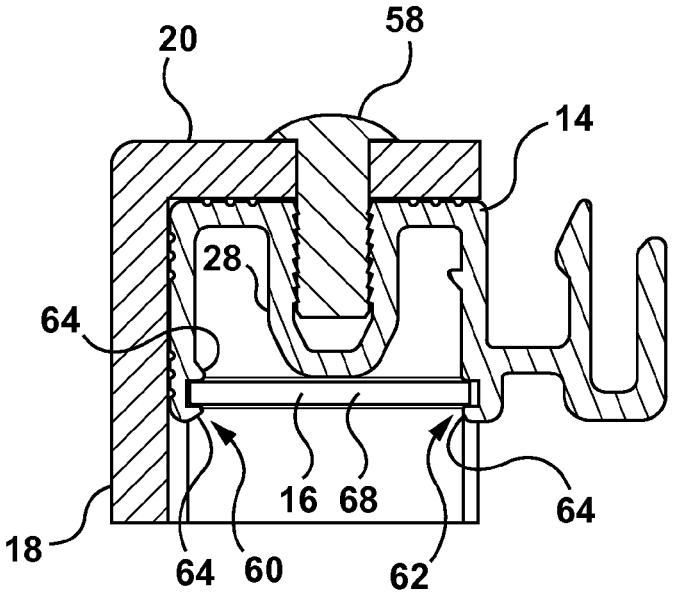
FIG. 5 is a cross section view of the wall panel assembly as taken along line B-B of FIG. 2.

With reference to FIGS. 3 to 5, each frame member 14 includes a pair of oppositely disposed corner member receiving slots 60, 62 for coupling with a corresponding corner member 16 at the corresponding frame member end portions 22, 24. The corner member receiving slots 60, 62 are defined by corner member receiving slot wall portions 64 disposed on both sides of the corner member receiving slots 60, 62. At least one of the receiving slot wall portions 64 may have an angled guide surface 66 for directing the corresponding frame member coupling portion 42, 44 into the corresponding receiving slot 60, 62 during assembly. The frame member coupling portions 42, 44 of corner member 16 each have frame member coupling portion end portions 68, 70. For greater ease of assembly, frame member coupling portion end portions 68, 70 may be tapered as shown in FIG. 4.

Figure 6:
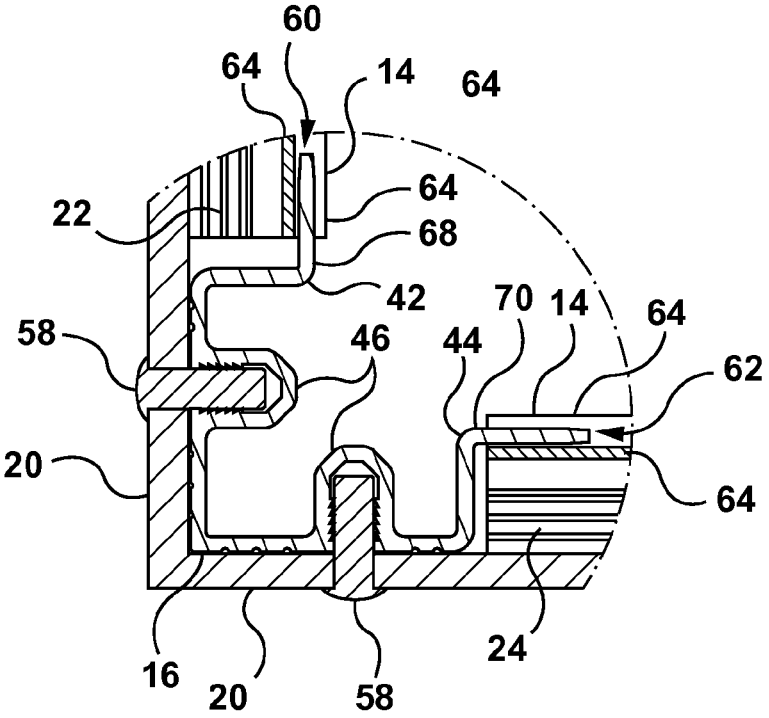
FIG. 6 is a detail view of one corner member coupled with the two frame member end portions and two panel side walls shown in FIG. 2.

One of the frame member coupling portion end portions 68, 70 is received by the corner member receiving slots 60, 62 of a corresponding one of the end portion 22 or 24 of a corresponding frame member 14 as shown in FIG. 6. The other one of the frame member coupling portion end portions 68, 70 is received by the corner member receiving slots 60, 62 of the corresponding end portion 22 or 24 of another corresponding frame member 14 as shown in FIG. 6. Once all of the frame member coupling portions 42, 44 of each corner member 16 are received in the corresponding pair of corner member receiving slots 60, 62 of the corresponding frame member 14, the assembly of support frame 26 is complete. The corner member 16 is received by the frame member 14 such that the first channel 28 and the second channels 46 are on the outer perimeter of the support frame 26. Accordingly, the first channel 28 and second channels 46 will be accessible by the fastener 58 during attachment of the wall panel 12 with the support frame 26. As shown in FIGS. 3 and 4, the frame member 14 and corner member 16 may be grooved or may have a grooved surface in areas where the frame member 14 and corner member 16 contact the wall panel 12. If a sealant or an adhesive is used for more secure coupling between the support frame 26 and the wall panel 12, then the grooves 72 provide additional space to accommodate the adhesive or sealant.

Figure 7:
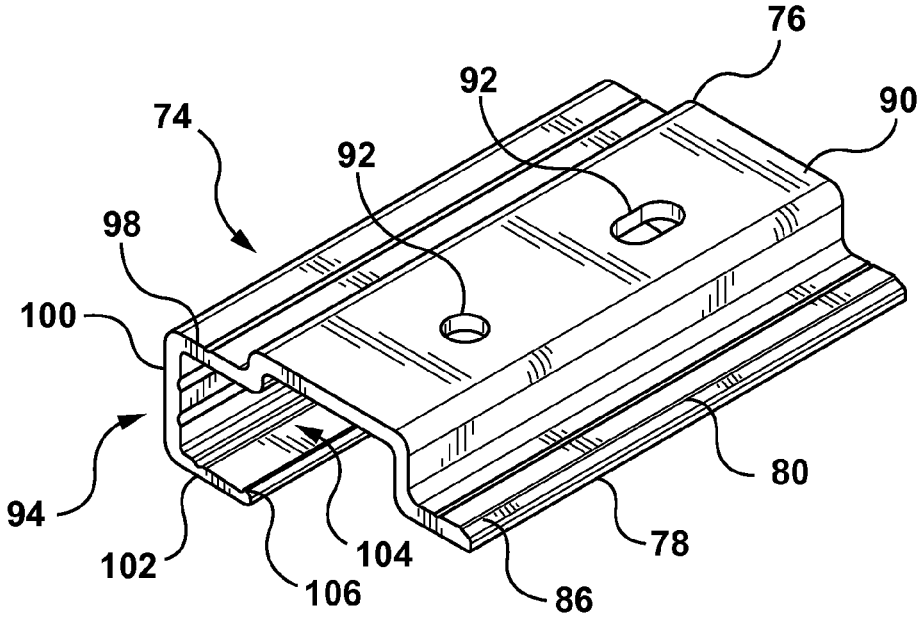
FIG. 7 is a perspective view of one embodiment of the wall coupling member.

FIG. 7 shows one embodiment of wall coupling member 74 wherein the wall coupling member 74 is a wall coupling clip 76. Wall coupling clip 76 includes a support frame coupling portion 78 such as a lip 80. As shown in FIG. 3, frame member 14 includes a wall coupling portion 82 which has a lip receiving slot 84. Lip 80 is received by lip receiving slot 84 during assembly of the wall panel assembly 10. The support frame coupling portion 78 or lip 80 may have an angled guide surface 86 which cooperates with the angled guide surface 88 on the lip receiving slot 84 of wall coupling portion 82. Cooperation of the guide surfaces 86, 88 facilitates the receiving of the lip 80 by the lip receiving slot 84. Wall coupling member 74 further includes a body portion 90 having one or more apertures 92 passing therethrough. Apertures 92 allow the passage of a fastener (not shown) for securing the wall coupling member 74 to a structural wall (not shown) to which the wall panel assembly 10 is applied.

Figure 9:
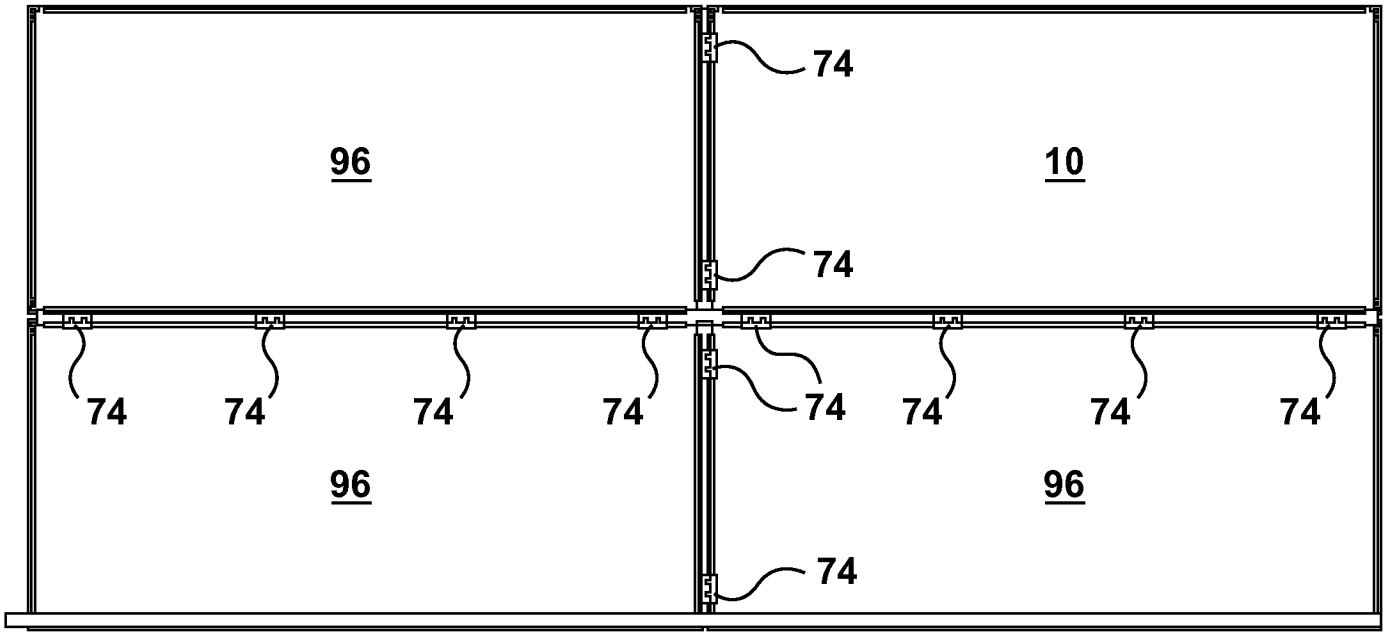
FIG. 9 is a perspective view of a wall panel assembly and adjacent wall panel assemblies.
Figure 11:
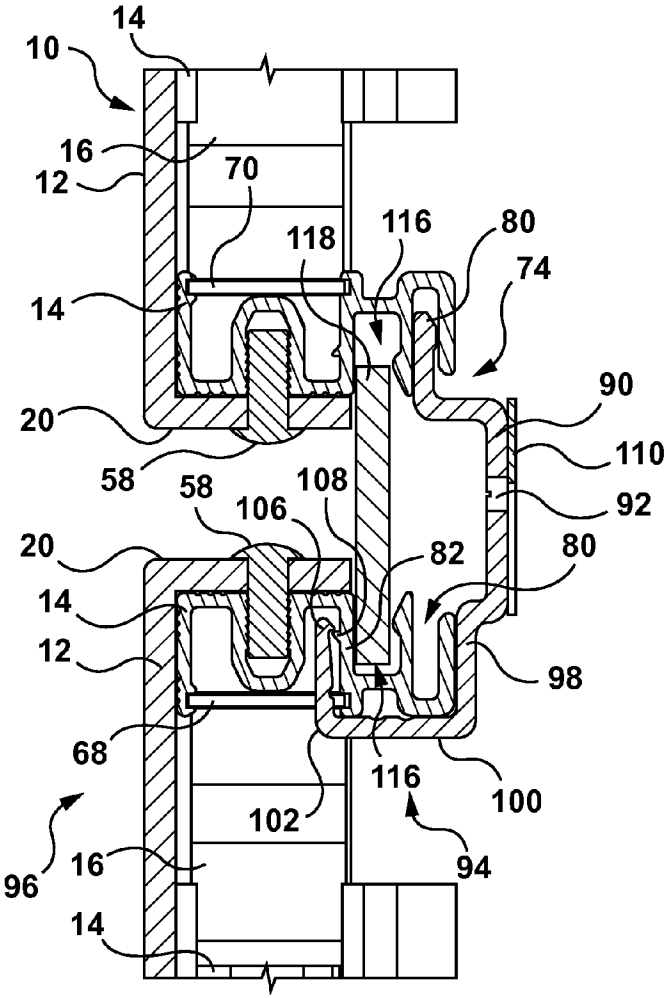

With reference to FIGS. 7, 9 and 11, wall coupling member 74 further includes a hook portion 94 which extends toward the wall coupling portion 82 of a frame member 14 of an adjacent wall panel assembly 96 (FIG. 9) when the wall coupling member 74 is attached to the structural wall (not shown). The hook portion 94 includes a shank portion 98, a base portion 100 and a point portion 102. The shank portion 98 and the point portion 100 have a gap 104 extending therebetween, the size of which is defined by the base portion 100. The point portion 102 also includes a first protuberance 106 extending into the gap 104. With reference to FIG. 11, during assembly, the wall coupling portion 82 of frame member 14 of an adjacent wall panel assembly 96 is received within the gap 104 formed by the hook portion 94 of wall coupling member 74. The first protuberance 106 engages a second protuberance 108 extending from wall coupling portion 82 of the frame member 14. The second protuberance 108 extends towards the first protuberance 106 and engages the first protuberance 106 by snap fit. In this manner, the support frame 26 of adjacent wall panel assembly 96 may be secured with the hook portion 94 of wall coupling member 74. A spacer 110 is positioned between the wall coupling member 74 and the structural wall (not shown).

Figure 8:
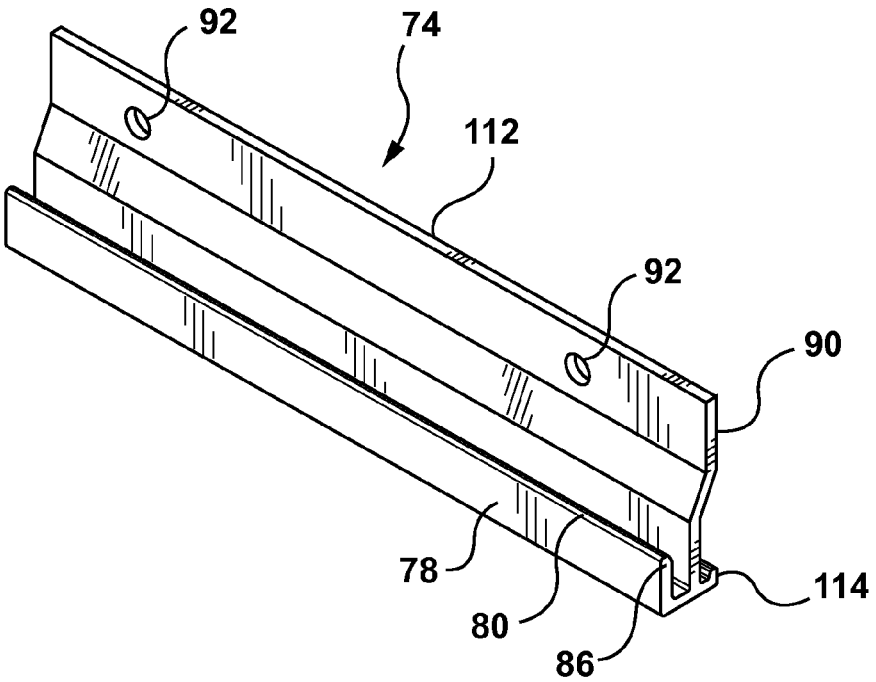
FIG. 8 is a cross section of another embodiment of the wall coupling member.
Figure 10:
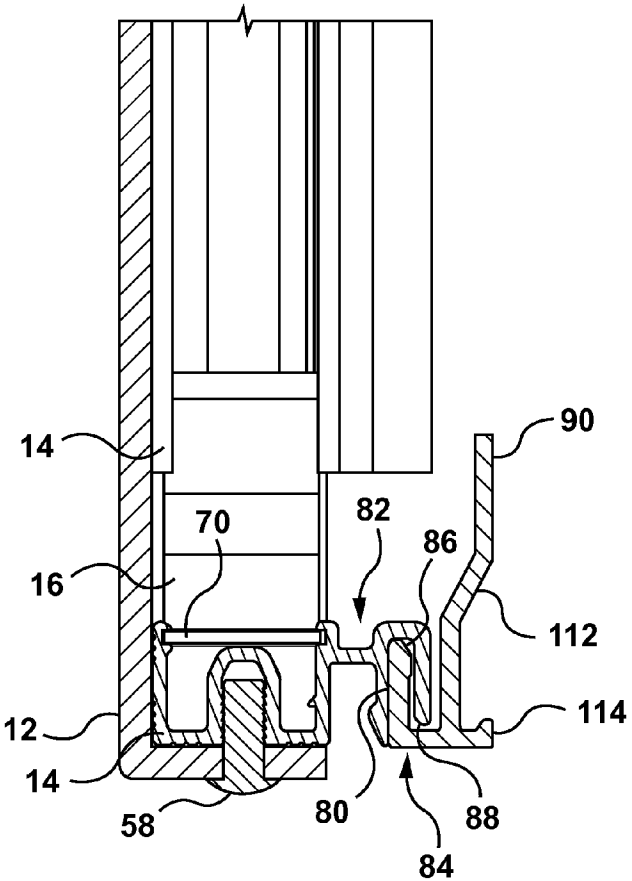
FIG. 10 is a cross section view of the wall coupling member of FIG. 8 coupled with a frame member; and, FIG. 11 is a perspective view of the wall coupling member of FIG. 7 coupling the wall panel assembly with an adjacent wall panel assembly.

Wall coupling member 74 may instead be a J-bar 112 as shown in FIGS. 8 and 10. J-bar 112 includes body portion 90 and further includes a support frame coupling portion 78 such as a lip 80 to be received by lip receiving slot 84 of frame member 14. Lip 80 may have an angled guide surface 86 which cooperates with the angled guide surface 88 on the lip receiving slot 84 of wall coupling portion 82 in the manner described above in relation to FIG. 7. Body portion 90 may have one or more apertures 92 passing therethrough. Apertures 92 allow the passage of a fastener (not shown) for securing the J-bar 112 to a structural wall (not shown) to which the wall panel assembly 10 is applied. J-bar 112 may also include a heel portion 114 for abutment with the structural wall (not shown).

With further reference to FIGS. 3 and 11, the frame member 14 includes a strip receiving channel 116 for receiving a strip 118 of material in the manner shown in FIG. 11. Strip 118 extends between the strip receiving channel 116 of wall panel assembly 10 and the strip receiving channel 116 of adjacent wall panel assembly 96. Preferably, strip 118 is made from a resilient material. Strip 118 maintains distance between wall panel assembly 10 and adjacent wall panel assembly 96 and prevents the two from moving closely together once they have been coupled together by the wall coupling portion 82. For example, strip 118 may prevent wall panel assembly 10 and adjacent wall panel assembly 96 from abutting one another. As shown in FIG. 3, strip receiving channel 116 includes a pair of oppositely disposed strip receiving channel side walls 120, 122 and a strip receiving channel base wall 124. At least one of the strip receiving channel side walls 120, 122 includes an embossment 126 extending therefrom toward the other one of the strip receiving channel side walls 120, 122 into the strip receiving channel 116. Embossment 126 provides an interference fit with the strip 118 when the strip 118 is received within the strip receiving channel 116.

While there have been described herein what are considered to be preferred and exemplary embodiments of the present invention, other modifications of these embodiments falling within the invention described herein shall be apparent to those skilled in the art.

What is claimed is:

1. A wall panel assembly comprising:

a panel having a main wall portion and sidewall portions extending away from the main wall portion;

a plurality of frame members each having opposing end portions and a first channel extending between the opposing end portions;

a plurality of corner members each having a pair of conjoined frame member coupling portions each frame member coupling portion of the pair of conjoined frame member coupling portions having a frame member coupling portion end portion extending therefrom for coupling with a corresponding end portion of a corresponding frame member of the plurality of frame members for defining a support frame for supporting the panel, wherein only the frame member coupling portion end portion of a respective conjoined frame member coupling portion is receivable within the corresponding end portions of the corresponding one of the frame members of the plurality of frame members, each frame member coupling portion of the pair of conjoined frame member coupling portions having a second channel extending therealong normal to the first channel of each frame member of the plurality of frame members; and, a plurality of fasteners for extending through the sidewall portions of the panel into the first channel of each frame member of the plurality of frame members and into the second channel of each frame member coupling portion of said pair of conjoined frame member coupling portions for coupling the panel with the support frame.

2. The assembly as in claim 1, wherein:

each of the opposing end portions of the plurality of frame members includes a pair of oppositely disposed corner member receiving slots; and, each frame member coupling portion end portion of each corner member of the plurality of corner members is receivable by the pair of oppositely disposed corner member receiving slots of the corresponding frame member end portion of the corresponding frame member of the plurality of frame members.

3. The assembly as in claim 2, wherein:

the corner member receiving slots are defined by corner member receiving slot wall portions disposed on both sides of each of the corner member receiving slots; and, at least one of the corner member receiving slot wall portions includes an angled guide surface for directing the corresponding frame member coupling portion into the pair of oppositely disposed corner member receiving slots.

4. The assembly as in claim 1 wherein each fastener of the plurality of fasteners is a pin-drive anchor.

5. The assembly as in claim 4, wherein:

each of the first channels includes oppositely disposed first channel side walls; and, at least one of the first channel side walls is textured for engagement with an expanding portion of the pin-drive anchor.

6. The assembly as in claim 1 wherein each fastener of the plurality of fasteners is a screw.

7. The assembly as in claim 6 wherein:

each of the first channels includes oppositely disposed first channel side walls; and, the first channel side walls are threaded for engagement with the screw.

8. The assembly as in claim 1, wherein:

at least one frame member of the plurality of frame members includes a wall coupling portion extending therefrom; and, at least one wall coupling member includes a support frame coupling portion coupled with the wall coupling portion of the at least one frame member of the plurality of frame members for supporting the wall panel assembly relative to a structural wall.

9. The assembly as in claim 8 wherein, the wall coupling portion of the at least one frame member of the plurality of frame members is a lip receiving slot; and, the support frame coupling portion includes a lip which is receivable by the lip receiving slot when the wall coupling member is attached to the structural wall.

10. The assembly as in claim 9, wherein:

the lip and the lip receiving portion each have cooperatively angled guide surfaces for guiding the lip and the lip receiving portion into engagement.

11. The assembly as in claim 8, further comprising:

a spacer for positioning between the wall coupling member and the structural wall when the wall coupling member is attached to the structural wall.

12. The assembly as in claim 8, wherein:

the wall coupling member includes a hook portion for extending toward the wall coupling portion of an adjacent wall panel assembly frame member when the wall coupling member is attached to the structural wall, the hook portion for coupling the wall coupling member with the wall coupling portion of the adjacent wall panel assembly frame member.

13. The assembly as in claim 12, wherein:

the hook portion includes a shank portion, a base portion and a point portion, the shank portion and the point portion having a gap therebetween, the point portion further including a first protuberance extending into the gap for engagement with a second protuberance extending toward the first protuberance from the wall coupling portion of the adjacent wall panel assembly frame member when the wall coupling portion of the adjacent wall panel assembly frame member is receivable within the gap.

14. The assembly as in claim 8, wherein:

the at least one wall coupling portion includes a first protuberance for snap fit engagement when the at least one wall coupling portion is receivable within a gap of a hook portion of an adjacent wall panel assembly having a shank portion, a base portion and a point portion, the shank portion and the point portion defining the gap therebetween and the point portion further including a second protuberance extending into the gap for engagement with the first protuberance.

15. The assembly as in claim 8, wherein:

the wall coupling portion further includes a strip receiving channel for receiving a strip for extending from the strip receiving channel into an adjacent wall panel assembly strip receiving channel to maintain distance between the wall panel assembly and the adjacent wall panel assembly.

16. The assembly as in claim 15, wherein:

the strip receiving channel includes a pair of parallel oppositely disposed strip receiving channel side walls and a strip receiving channel base wall;

at least one of the strip receiving channel side walls has an embossment extending into the strip receiving channel for interference fit with the strip when the strip is received in the strip receiving channel.

17. The assembly as in claim 1, wherein:

each frame member of the plurality of frame members has a grooved surface for contacting the sidewall portions of the panel.

18. The assembly as in claim 1, wherein:

each corner member of the plurality of corner members has a grooved surface for contacting the sidewall portions of the panel.

19. The assembly as in claim 1, wherein:

each first channel includes at least one aperture passing therethrough for allowing passage of moisture from the first channel.

20. The assembly as in claim 1, wherein:

each second channel includes at least one aperture passing therethrough for allowing passage of moisture from the second channel.

* * * * *